US009703219B1

(12) United States Patent
Matsubara et al.

(10) Patent No.: US 9,703,219 B1
(45) Date of Patent: Jul. 11, 2017

(54) ELECTROSTATIC IMAGE DEVELOPING TONER

(71) Applicant: Konica Minolta, Inc., Tokyo (JP)

(72) Inventors: Masaharu Matsubara, Hachioji (JP); Takanari Kayamori, Kawasaki (JP); Naoya Tonegawa, Sagamihara (JP); Kouji Sekiguchi, Tokyo (JP); Atsushi Iloka, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/274,417

(22) Filed: Sep. 23, 2016

(30) Foreign Application Priority Data

Jun. 1, 2016 (JP) ..... 2016-109677

(51) Int. Cl.

| | |
|---|---|
| ***G03G 9/087*** | (2006.01) |
| ***G03G 9/097*** | (2006.01) |
| ***G03G 9/08*** | (2006.01) |
| ***G03G 9/09*** | (2006.01) |

(52) U.S. Cl.
CPC ..... *G03G 9/08755* (2013.01); *G03G 9/0825* (2013.01); *G03G 9/08797* (2013.01); *G03G 9/091* (2013.01)

(58) Field of Classification Search
CPC ..... G03G 9/08755; G03G 9/097
See application file for complete search history.

(56) References Cited

U.S. PATENT DOCUMENTS

| | | | |
|---|---|---|---|
| 3,441,426 | A | 4/1969 | Van den Heuvel et al. |
| 5,889,162 | A | 3/1999 | Hays |

FOREIGN PATENT DOCUMENTS

| | | | |
|---|---|---|---|
| JP | S58-062668 | A | 4/1983 |
| JP | S59-157653 | A | 9/1984 |
| JP | 2000075552 | A | 3/2000 |
| JP | 2001109152 | A | 4/2001 |
| JP | 2006313302 | A | 11/2006 |
| JP | 2007-533802 | A | 11/2007 |
| JP | 2011027869 | A | 2/2011 |
| JP | 2013257415 | A | 12/2013 |
| JP | 2014186194 | A | 10/2014 |
| JP | 2014-235362 | A | 12/2014 |

OTHER PUBLICATIONS

Notice of Allowance dated Nov. 22, 2016 from corresponding Japanese Application; Japanese Patent Application No. 2016-109677; English translation of Notice of Allowance; Total of 4 pages.

*Primary Examiner* — Hoa V Le
(74) *Attorney, Agent, or Firm* — Lucas & Mercanti, LLP

(57) ABSTRACT

Provided is an electrostatic image developing toner containing toner particles having a domain-matrix structure formed with a matrix of an amorphous polyester resin and a domain of a crystalline resin, wherein the toner particles contain an releasing agent and alkoxy aniline; and a content of the alkoxy aniline contained in the toner particles is in the range of 0.1 to 15.0 mass ppm.

11 Claims, No Drawings

ELECTROSTATIC IMAGE DEVELOPING TONER

This application is based on Japanese Patent Application No. 2016-109677 filed on Jun. 1, 2016 with Japan Patent Office, the entire content of which is hereby incorporated by reference.

TECHNICAL FIELD

The present invention relates to an electrostatic image developing toner. More specifically, the present invention relates to an electrostatic image developing toner excellent in low-temperature fixing property with suppressed toner scattering.

BACKGROUND

An electrophotographic image forming apparatus forms an image using an electrostatic image developing toner (hereafter, it may be simply called as a toner) on a transfer medium such as paper, then, the formed toner image is fixed.

As a fixing method, a heat roller fixing method is widely used. In this method, the transfer medium after formed an image thereon is passed between a heat roller and a pressure roller. The heat roller are required to have a high heat capacity in order to obtain a high fixing property, namely, to obtain a high toner adhesion property on the transfer medium.

From the viewpoint of preventing warming of a global environment in recent years, there is an increasing demand for energy saving with respect to an electrophotographic image forming apparatus. Therefore, in an image forming apparatus employing a heat roller fixing system, many investigations have been made for achieving a low-temperature fixing toner in order to reduce the amount of heat required for fixing.

A most representative toner aiming at the low-temperature fixing is a toner using a crystalline resin.

For example, it was proposed a toner containing a crystalline polyester resin as a threadlike crystalline structure. This toner enabled to achieve a sharp-melting property of the crystalline polyester resin and improved low-temperature fixing (Patent document 1: JP-A No. 2013-257415).

Further, it was proposed a toner having a crystalline polyester resin finely dispersed as a domain phase of an average size of 300 nm or less in an amorphous resin. This structure was achieved by adjusting a content of a carboxy group in the amorphous resin and a content of an ester group in the crystalline polyester resin (Patent document 2: JP-A No. 2014-186194).

The crystalline polyester resin in this toner will promote compatibility during the heat fixing. In addition, it has a small degree of crystallization and a small amount of dispersion in the degree of crystallization. As a result, the image formed with this toner will have an improved uniform glossiness.

Moreover, it was proposed a technology of improving a sharp-melting property and stress-resisting property of a toner by including a releasing agent in toner particles so as to adjust compatibility of the crystalline polyester resin with the amorphous resin (Patent document 3: JP-A No. 2011-27869).

As coloring agents in yellow toners, there are used pigments such as: C. I. Pigment Yellow 93, C. I. Pigment Yellow 155, C. I. Pigment Yellow 180, C. I. Solvent Yellow 93, and C. I. Solvent Yellow 163.

These coloring agents have insufficient coloring power when used alone. In order to obtain a required coloring power, an added amount of the coloring agent has to be increased. However, when the added amount of the coloring agent is increased, the incorporating capacity of the coloring agent in the toner will be lowered, and there are produced problems that the charging property is decreased and the toner is easily scattered.

In order to solve the above-described problems, it was proposed a method of improving the dispersion property and the charging property of the pigment in the toner by incorporating a charge controlling agent such as a metal compound of salicylic acid in the toner particles (Patent document 4: JP-A No. 2000-75552; and Patent document 5: JP-A No. 2001-109152). In addition, it was proposed a method of improving a coloring power and a charging property by incorporating C. I. Pigment Yellow 155 and C. I. Solvent Yellow 162 in the toner particles as a coloring agent (Patent document 6: JP-A No. 2006-313302).

However, since the toner particles are constituted of multiple components such as a crystalline resin, an amorphous resin, and a releasing agent, each constituting component will likely gather. Therefore, it is difficult to sufficiently disperse the crystalline resin into the toner particles by using a known method. There is a problem that full functions of the crystalline resin are hardly obtained.

SUMMARY

The present invention was done based on the above-described problems and situations. An object of the present invention is to provide an electrostatic image developing toner excellent in low-temperature fixing property with suppressed toner scattering.

The present inventors have made investigation to solve the above-described problems, and have achieved the present invention. In an electrostatic image developing toner containing toner particles having a domain-matrix structure formed with a matrix of an amorphous resin and a domain of a crystalline resin, it was found to provide an electrostatic image developing toner excellent in low-temperature fixing property with suppressed toner scattering by incorporating an releasing agent and a predetermined amount of alkoxy aniline into the toner particles.

Namely, the problems relating to the present invention are solved by the following embodiments.

1. An electrostatic image developing toner containing toner particles having a domain-matrix structure formed with a matrix of an amorphous polyester resin and a domain of a crystalline resin, wherein the toner particles contain an releasing agent and alkoxy aniline; and a content of the alkoxy aniline contained in the toner particles is in the range of 0.1 to 15.0 mass ppm.

2. The electrostatic image developing toner described in the embodiment 1, wherein the releasing agent has a melting point in the range of 60 to 90° C.

3. The electrostatic image developing toner described in the embodiments 1 or 2, wherein the toner particles contain C. I. Pigment Yellow 74 as a pigment.

4. The electrostatic image developing toner described in the embodiment 3, wherein the toner particles contain at least one pigment selected from the group consisting of: C. I. Pigment Yellow 93, C. I. Pigment Yellow 155, C. I. Pigment Yellow 180, C. I. Pigment Yellow 185, C. I. Solvent Yellow 93, and C. I. Solvent Yellow 163.

5. The electrostatic image developing toner described in any one of the embodiments 1 to 4, wherein the crystalline resin in the toner particles is a crystalline polyester resin.

6. The electrostatic image developing toner described in the embodiment 5, wherein a content of the crystalline polyester resin in the toner particles is in the range of 5 to 30 mass %.

7. The electrostatic image developing toner described in the embodiment 5, wherein the crystalline polyester resin is a hybrid resin bonded with an amorphous resin segment.

8. The electrostatic image developing toner described in the embodiment 5, wherein the crystalline polyester resin has an acid value in the range of 15 to 30 mg KOH/g.

9. The electrostatic image developing toner described in any one of the embodiments 1 to 8, wherein the alkoxy aniline is 2-methoxyaniline.

10. The electrostatic image developing toner described in any one of the embodiments 5 to 8, wherein the amorphous polyester resin has a high molecular weight component and a low molecular weight component;

the high molecular weight component has a weight average molecular weight (Mw) in the range of 30,000 to 300,000; and the low molecular weight component has a weight average molecular weight (Mw) in the range of 8,000 to 25,000.

11. The electrostatic image developing toner described in the embodiment 10, wherein the high molecular weight component in the amorphous polyester resin has an acid value smaller than the acid value of the crystalline polyester resin.

By the above-described embodiments, it is possible to provide an electrostatic image developing toner excellent in low-temperature fixing property with suppressed toner scattering. A formation mechanism or an action mechanism of the effects of the present invention is not made clear, but it is supposed to be as follows.

In a toner containing toner particles having a domain-matrix structure in which an amorphous polyester resin is made to be a matrix and a crystalline resin is made to be a domain, the crystalline resin to form a domain is required to be uniformly dispersed in a matrix of the amorphous polyester resin in order to achieve a required low-temperature fixing property. However, since toner particles are composed of multiple components of an amorphous resin, a crystalline resin, and a releasing agent, the same constituting component will likely gather with each other. A dispersion property of the multiple components in the toner particles is likely destroyed.

The present inventors found that the dispersing property of the releasing agent domain and the crystalline resin domain in the toner particles were increased when alkoxy aniline was contained in the toner particles in the range of 0.1 to 15.0 mass ppm. The reason of this is supposed as follows.

Alkoxy aniline that carries a positive electric charge in the matrix will enclose the releasing agent and the crystalline resin both having a negative electric charge. As a result, the releasing agent domain and the crystalline resin domain each respectively hindered to be aggregated. The components of the same kind are hardly gathered together.

Further, when the releasing agent domains are uniformly dispersed in the toner particles, the releasing agent domains are located among the crystalline resin domains. As a result, the crystalline resin domains are hardly gathered together. By this, the dispersing property of the crystalline resin domains in the toner particles is extremely improved, and it may be obtained a toner excellent in low-temperature fixing property.

Further, by making the content of the alkoxy aniline in the toner particles to be 15.0 mass ppm or less, it can control the amount of the positive electric charge in the toner particles and scattering of the toner particles may be restrained.

DESCRIPTION OF THE PREFERRED EMBODIMENTS

An electrostatic image developing toner of the present invention contains toner particles having a domain-matrix structure formed with a matrix of an amorphous polyester resin and a domain of a crystalline resin. It is characterized in that the toner particles contain a releasing agent and alkoxy aniline; and a content of the alkoxy aniline contained in the toner particles is in the range of 0.1 to 15.0 mass ppm. This technical feature is common to the inventions relating to the above-described embodiments.

A preferable embodiment of the present invention is that the releasing agent has a melting point in the range of 60 to 90° C. By this, the releasing agent may be easily maintained in a dispersed condition in the toner particles during production of the toner. While maintaining the releasing property, it may be restrained exposure of the releasing agent on the surface of the toner particle. Further, as a result of improved compatibility between the releasing agent and the crystalline resin, it can adjust the compatibility property between the amorphous resin and the crystalline resin.

Another preferable embodiment of the present invention is that the toner particles contain C. I. Pigment Yellow 74 as a pigment. By this, a yellow toner will obtain an excellent coloring power with a small amount of coloring agent. Further, by the effect of restraining the content of the pigment, the incorporating capacity of the coloring agent in the toner particles will be increased, and lowering of the charging property and toner scattering will be prevented. Moreover, by restraining the content of the pigment, an excellent low-temperature fixing property will be obtained through control of a filler effect.

From the viewpoint of obtaining a required hue and high coloring power, a preferable embodiment of the present invention uses toner particles containing at least one pigment selected from the group consisting of: C. I. Pigment Yellow 93, C. I. Pigment Yellow 155, C. I. Pigment Yellow 180, C. I. Pigment Yellow 185, C. I. Solvent Yellow 93, and C. I. Solvent Yellow 163.

Another preferable embodiment of the present invention is that the toner particles contain a crystalline polyester resin as the crystalline resin from the viewpoint of obtaining an excellent low-temperature fixing property.

Another preferable embodiment of the present invention is that a content of the crystalline polyester resin in the toner particles is in the range of 5 to 30 mass %. Here, the content of the crystalline resin is preferably 5 mass % or more from the viewpoint of obtaining an excellent low-temperature fixing property, and it is preferably 30 mass % or less from the viewpoint of preventing toner scattering.

Another preferable embodiment of the present invention is that the crystalline polyester resin is a hybrid resin bonded with an amorphous resin segment from the viewpoint of increasing the dispersing property of the crystalline polyester resin in the amorphous resin and obtaining an excellent low-temperature fixing property.

Another preferable embodiment of the present invention is that the crystalline polyester resin has an acid value in the range of 15 to 30 mg KOH/g. Here, the acid value is preferably 15 mg KOH/g or more from the viewpoint that the alkoxy aniline will easily enclose the crystalline polyester resin and will increase the dispersing property of the crystalline polyester resin to result in improving the low-temperature fixing property. In addition, the acid value is preferably 30 mg KOH/g or less from the viewpoint of preventing decrease of the amount of electric charge of the toner particles. When the hydrophilicity increases, the crystalline polyester resin will likely exist on the surface of the toner particle.

Another preferable embodiment of the present invention is that the alkoxy aniline is 2-methoxyaniline from the viewpoint of increasing the dispersion property of the crystalline resin and preventing the amorphous resin from plasticizing.

Another preferable embodiment of the present invention is that: the amorphous polyester resin has a high molecular weight component and a low molecular weight component; the high molecular weight component has a weight average molecular weight (Mw) in the range of 30,000 to 300,000; and the low molecular weight component has a weight average molecular weight (Mw) in the range of 8,000 to 25,000. By this, it may increase compatibility of the high molecular weight component with the crystalline resin, and it can adjust separation of the crystalline resin once dissolved. Further, by using both a high molecular weight component and a low molecular weight component, inclusion of the high molecular weight component into the toner particles will be easily done and it can prevent exposure of the crystalline resin on the surface of the toner particles, when the toner is produced with an emulsion polymerization aggregation method, and the aggregated particles composed of the raw materials are heated to fuse. In addition, since the existing probability of the crystalline resin domains in the vicinity of the toner particle surface, the distribution of the amount of the electric charge is not spread, and generation of toner scattering is prevented.

Another preferable embodiment of the present invention is that the high molecular weight component in the amorphous polyester resin has an acid value smaller than the acid value of the crystalline polyester resin. By this, the alkoxy aniline will easily enclose the crystalline polyester resin to result in increasing the dispersing property of the crystalline polyester resin.

The present invention and the constitution elements thereof, as well as the embodiments to carry out the present invention, will be detailed in the following. In the present description, when two figures are used to indicate a range of value before and after "to", these figures themselves are included in the range as a lowest limit value and an upper limit value.

[Electrostatic Image Developing Toner]

An electrostatic image developing toner of the present invention contains toner particles having an amorphous resin and a crystalline resin as binder resins, and the toner particles have a domain-matrix structure formed with a matrix of an amorphous polyester resin as an amorphous resin and a domain of a crystalline resin.

A domain-matrix structure designates a structure in which there exists a domain phase having a closed boundary face (interface between two phases) in a continuous matrix phase. Here, the toner particles according to the present invention have a matrix phase of an amorphous polyester resin excellent in heat-resisting property, and a crystalline resin is dispersed as a domain phase in this matrix phase.

The toner particles according to the present invention contain a releasing agent and alkoxy aniline, and a content of the alkoxy aniline in the toner particles is from 0.1 to 15.0 mass ppm.

The toner particles may further contain a coloring agent, and when needed, they may also contain a charge controlling agent and an external additive.

<Amorphous Resin>

The toner particles according to the present invention contain an amorphous polyester resin as an amorphous resin. The amorphous resin may be used alone, or two or more kinds of amorphous resins may be used. A molecular weight of the used amorphous resin is not limited in particular. Here, an amorphous property designates a property that indicates a glass transition point (Tg) in an endothermic curve obtained by measurement with differential scanning calorimetry (DSC), but does not indicate a clear endothermic peak at a melting point during the temperature rising step. Here, "a clear endothermic peak" designates a endothermic peak having a half bandwidth within 15° C. in an endothermic curve obtained under the condition of a temperature raising rate of 10° C./min.

<Amorphous Polyester Resin>

As an amorphous polyester resin according to the present invention, it is preferable to use two kinds of resins. One is an amorphous polyester resin having a high weight average molecular weight (Mw) (high molecular weight component), and the other is an amorphous polyester resin having a low weight average molecular weight (Mw) (low molecular weight component).

In this embodiment, a weight average molecular weight (Mw) of a high molecular weight component is preferably in the range of 30,000 to 300,000, more preferably in the range of 30,000 to 200,000, still more preferably in the range of 35,000 to 150,000.

On the other hand, a weight average molecular weight (Mw) of a low molecular weight component is preferably in the range of 8,000 to 25,000, more preferably in the range of 8,000 to 22,000, still more preferably in the range of 9,000 to 20,000.

By this, it may increase compatibility of the high molecular weight component with the crystalline resin, and it can adjust separation of the crystalline resin once dissolved. Further, by using both a high molecular weight component and a low molecular weight component, inclusion of the high molecular weight component into the toner particles will be easily done and it can prevent exposure of the crystalline resin on the surface of the toner particles, when the toner is produced with an emulsion polymerization aggregation method, and the aggregated particles composed of the raw materials are heated to fuse. In addition, since the existing probability of the crystalline resin domains in the vicinity of the toner particle surface, the distribution of the amount of the electric charge is not spread, and generation of toner scattering is prevented.

When the high molecular weight component and the low molecular weight component are used by mixing, the mixing ratio of the two components is preferably in the range of 35:65 to 95:5, more preferably in the range of 40:60 to 90:10, and still more preferably in the range of 50:50 to 85:15. By mixing them in this range, a low-temperature fixing property may be maintained while having the above-described effects.

The high molecular weight component is preferably contains: alkenyl succinic acid or its anhydride; and trimellitic acid or its anhydride as the constituting monomers. Alkenyl succinic acid or its anhydride is easily compatible with the crystalline resin by the existence of the alkenyl group having high hydrophobicity.

As an alkenyl succinic acid component, it may be cited: n-dodecenylsuccinic acid, isododecenyl succinic acid, n-octenyl succinic acid, anhydrides and acid chlorides of these acids, and lower alkyl esters having carbon atoms of 1 to 3 of these acids. By incorporating polycarboxylic acid having 3 valence or more, the polymer chain will form a cross-linking structure. As a result of forming a cross-linking structure, it can fix the crystalline resin once dissolved and it becomes difficult to separate. Examples of polycarboxylic acid having 3 valence or more are: hemimellitic acid, trimellitic acid, trimesic acid, mellophanic acid, prehnitic acid, pyromellitic acid, mellitic acid, 1,2,3,4-butane tetracarboxylic acid, anhydrides and acid chlorides of these acids, and lower alkyl esters having carbon atoms of 1 to 3 of these acids.

A production method of an amorphous polyester resin is not limited in particular, it is produced with a common polyester polymerization method.

As a carboxylic component used for preparation of an amorphous polyester resin, the following may be cited: saturated aliphatic dicarboxylic acids such oxalic acid, malonic acid, succinic acid, adipic acid, sebacic acid, azelaic acid, n-dodecyl succinic acid, nonane dicarboxylic acid, decane dicarboxylic acid, undecane dicarboxylic acid, dodecane dicarboxylic acid, (tetradecanedioic acid), and tetradecane dicarboxylic acid; alicyclic dicarboxylic acid such as cyclohexane dicarboxylic acid; aromatic dicarboxylic acids such as phthalic acid, isophthalic acid, and terephthalic acid; a polycarboxylic acid having two or more valence such as trimellitic acid, and pyromellitic acid. Further, as a derivative of a polycarboxylic acid, it may be cited acid anhydrides and alkyl esters of 1 to 3 carbon atoms of these carboxylic acid compounds. These may be used alone, or they may be used in combination of two or more kinds.

As an alcohol component used for preparation of an amorphous polyester resin, the following may be cited: aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentyl glycol, and 1,4-butenediol; and polyhydric alcohols having three or more valence such as glycerin, pentaerythritol, trimethylol propane and sorbitol. These may be used alone, or they may be used in combination of two or more kinds.

In addition to the above-describe alcohol components, it may be used the following: bisphenol A, bisphenol A-ethylene oxide adduct, bisphenol A-propylene oxide adduct, bisphenol S, bisphenol S-ethylene oxide adduct, and bisphenol S-propylene oxide adduct.

From the viewpoint of toner production, heat-resisting property, and transparency, it is preferable to use bisphenol S, or a bisphenol S derivative such as bisphenol S-ethylene oxide adduct or bisphenol S-propylene oxide adduct. It may be used plural carboxylic acid components and plural alcohol components. Specifically, a heat-resisting property is increased when bisphenol S is used.

A glass transition point of the low molecular component in the amorphous polyester resin is preferably in the range of 45 to 75° C., more preferably in the range of 50 to 70° C., and still more preferably in the range of 55 to 65° C.

A glass transition point of the high molecular component in the amorphous polyester resin is preferably in the range of 45 to 75° C., more preferably in the range of 50 to 70° C., and still more preferably in the range of 55 to 66° C.

By making the glass transition points of the amorphous polyester resins to be in the above-described range, it can obtain both a sufficient low-temperature fixing property and heat-resisting storage stability.

A glass transition point (Tg) may be measured by using a differential scanning calorimeter such as "Diamond DSC" (PerkinElmer Inc.), for example. Specific measurement is done as follows.

First, 3.0 mg of measuring sample is sealed in an aluminum pan and the temperature is changed in the order of heating-cooling-heating. In the first heating step, the temperature is increased from room temperature (25° C.), and in the second heating step, the temperature is increased from 0° C. In both heating steps, the temperature is raised to 200° C. at a heating rate of 10° C./min, then the temperature is kept at 200° C. for 5 minutes. In the cooling step, the temperature is decreased from 200° C. to 0° C. at a cooling rate of 10° C./min. Then the temperature is kept at 0° C. for 5 minutes. A shift of a base line in the measurement curve obtained in the second heating step is observed. A cross point of an extended line of a base line before shifted and a tangential line indicating a maximum slope in the shift portion of the base line is determined as a glass transition point (Tg). An empty aluminum pan is used for a reference.

A weight average molecular weight (Mw) of the above-described amorphous polyester resin may be determined from the molecular weight distribution obtained by gel permeation chromatography (GPC) as indicted in the following.

A measuring sample is dissolved in tetrahydrofuran to a concentration of 1 mg/mL by a treatment with an ultrasonic disperser at a temperature of 40° C. for 15 minutes. The solution is then treated with a membrane filter having a pore size of 0.2 μm to obtain a sample solution.

A GPC device "HLC-8120 GPC" (TOSOH Corp.) and a column set "TSK guard column+3×TSK gel Super HZM-M" (TOSOH Corp.) are used. The column temperature is held at 40° C., and tetrahydrofuran (THF) is supplied at a flow rate of 0.2 mL/min as a carrier solvent. An aliquot (10 μL) of the sample solution is injected into the device along with the carrier solvent and the sample is detected by means of a refractive index (RI) detector. The molecular weight distribution of the sample is calculated by using a calibration curve, which is determined by using standard monodisperse polystyrene particles (made by Pressure Chemical Co. Ltd.). The calibration curve is prepared by using 10 kinds of polystyrene particles each having a molecular weight of: $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

When the acid value of the amorphous polyester resin is made smaller than the acid value of the crystalline resin, alkoxy aniline will easily enclose the crystalline resin, and the dispersing property of the crystalline resin will be sufficiently increased. This is a preferable embodiment.

An acid value of an amorphous polyester resin may be measured based on the method described in JIS K0070-1992 (potentiometric titration). In the present measurement, a used solvent is a mixture of tetrahydrofuran and isopropyl alcohol having a volume ratio of 1:1.

<Crystalline Resin>

A crystalline resin is used as a binder resin of the present invention. A known crystalline resin may be used without any limitation as long as it exhibits a crystalline property. Here, when a resin exhibits a crystalline property, it means that the resin has a clear endothermic peak of melting point in an endothermic curve obtained by DSC during the temperature increasing step. Here, "a clear endothermic peak" designates a peak having a half bandwidth within 15° C. in an endothermic curve under the condition of a temperature raising rate of 10° C./min.

From the viewpoint of obtaining a low-temperature fixing property, the toner particles preferably contain a crystalline polyester resin as a crystalline resin.

In addition, a content of the crystalline polyester resin in the toner particles is preferably in the range of 5 to 30 mass %. When the content in the toner particles is 5 mass % or more, a sufficient low-temperature fixing property may be obtained, and when the content in the toner particles is 30 mass % or less, it may be prevented toner scattering due to lowering of the charging property.

<Crystalline Polyester Resin>

A crystalline polyester resin is a resin exhibiting crystalline property among polyester resins prepared by polymerization of a monomer of carboxylic acid having two or more valence (polycarboxylic acid) and a monomer of alcohol having two or more valence (polyhydric alcohol).

The crystalline polyester resin may be formed in the same way as preparation of the above-described amorphous polyester resin.

Examples of a polycarboxylic acid monomer usable for preparation of the crystalline polyester resin are: saturated aliphatic dicarboxylic acids such as oxalic acid, malonic acid, succinic acid, adipic acid, sebacic acid, azelaic acid, n-dodecyl succinic acid, 1,10-decane dicarboxylic acid (dodecanedioic acid), and 1,12-dodecane dicarboxylic acid (tetradecanedioic acid); alicyclic dicarboxylic acid such as cyclohexane dicarboxylic acid; aromatic dicarboxylic acids such as phthalic acid, isophthalic acid, and terephthalic acid; and polycarboxylic acids having three valence or more such as trimellitic acid, and pyromellitic acid. Further, it may be cited acid anhydrides and alkyl esters of 1 to 3 carbon atoms of these carboxylic acid compounds. These may be used alone, or they may be used in combination of two or more kinds.

Examples of a polyhydric alcohol monomer usable for preparation of the crystalline polyester resin are: aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, neopentyl glycol, and 1,4-butenediol; polyhydric alcohols having three or more valence such as glycerin, pentaerythritol, trimethylol propane and sorbitol. These may be used alone, or they may be used in combination of two or more kinds.

(Hybrid Resin)

A crystalline polyester resin used in the present invention is preferably a hybrid resin bonded with an amorphous resin segment. The hybrid resin can adjust affinity with the amorphous resin so that the crystalline resin will be uniformly dispersed in the amorphous resin.

In the hybrid resin, a resin portion having a structure derived from the crystalline polyester resin is called as a crystalline polyester resin segment, and a resin portion having a structure derived from the amorphous resin is called as an amorphous resin segment. The amorphous resin segment in the hybrid crystalline resin has high affinity with the amorphous resin used as a matrix phase. As a result, a molecular chain of the crystalline resin segment will be easily arrayed, and it may be obtained a sufficient crystalline property.

A content of the crystalline polyester resin segment in the hybrid resin is preferably in the range of 50 to 98 mass % from the viewpoint of giving a sufficient crystalline property to the hybrid resin.

The composition and the content of each segment such as crystalline polyester resin segment in the hybrid resin may be determined, for example, by NMR analysis or by methylation reaction Pyrolysis Gas Chromatography with Mass Spectrometry (Py-GC/MS).

The amorphous resin segment is not limited in particular as long as it exhibits an amorphous property. It may be cited: amorphous polyester resin segment, amorphous vinyl resin segment, amorphous urethane resin segment, and amorphous urea resin segment. Among them, when an amorphous resin segment contains a derivative of an amorphous polyester resin used as a binder resin, it may be increased compatibility with the amorphous resin in the matrix phase. Consequently, a uniform charging property may be obtained.

A content of the amorphous resin segment in the hybrid resin is in the range of 40 to 60 mass %, more preferably in the range of 45 to 50 mass %.

As a preparation method of the above-described hybrid resin, it may be cited, for example, the following preparation methods (1) to (3).

(1) A method having the following steps of: reacting a bireactive monomer with a crystalline polyester resin prepared beforehand; then, reacting a raw material monomer used for producing an amorphous resin to result in forming a chemical bond between the crystalline polyester resin segment and the amorphous resin segment.

(2) A method having the following steps of: reacting a bireactive monomer with an amorphous polyester resin prepared beforehand; then, reacting a polycarboxylic acid monomer and a polyhydric alcohol monomer, both being raw materials for producing a crystalline polyester resin, to result in forming a chemical bond between the amorphous resin segment and the crystalline polyester resin segment.

(3) A method having the following steps of: respectively forming a crystalline polyester resin and an amorphous resin beforehand; then, bonding these two substances with a bireactive monomer to form a hybrid resin having two segments.

A bireactive monomer is a monomer enabling to bind a crystalline polyester resin and an amorphous resin. It is a monomer containing a substituent capable of reacting with a crystalline polyester resin such as a hydroxy group, a carboxy group, an epoxy group, a primary amino group, and a secondary amino group; and an ethylenically unsaturated group capable of reacting with an amorphous resin. Among them, preferable is a vinyl carboxylic acid having a hydroxy group or a carboxy group and an ethylenically unsaturated group.

As a bireactive monomer, it may be cited: (meth)acrylic acid, fumaric acid, and maleic acid. It may be used esters of a hydroxyalkyl group (carbon atom number of 1 to 3). From the viewpoint of reactivity, preferable are: acrylic acid, methacrylic acid and fumaric acid.

An added amount of the bireactive monomer is preferably in the range of 1 to 10 mass parts, more preferably in the range of 4 to 8 mass parts with respect to 100 mass parts of the total monomers used for forming the amorphous resin segment from the viewpoint of improving the low-temperature fixing property, the hot offset resistivity, and the durability of the toner.

An acid value of the crystalline polyester resin according to the present invention is preferably in the range of 15 to 30 mg KOH/g.

When the acid vale is 15 mg KOH/g or more, the alkoxy aniline will easily enclose the crystalline polyester resin. As a result, it will be increased the dispersing property of the crystalline polyester resin to result in improving the low-temperature fixing property.

When the acid vale is 30 mg KOH/g or less, the hydrophilicity will be increased and it may prevent uneven distribution of the crystalline polyester resin on the surface the toner particles. As a result, it may be prevented decrease of the charging property cause by uneven distribution.

(Acid Value)

An acid value is an amount of potassium hydroxide (KOH) in mg required to neutralize the carboxy group existing in 1 g of sample. The acid value is measured based on the method described in JIS K0070-1966.

(Preparation of Reagents)

(a) Phenolphthalein Solution 1.0 g of phenolphthalein is dissolved in 90 mL of ethyl alcohol (95 vol %), then ion-exchanged water is added to make a volume of 100 mL. Thus, a phenolphthalein solution is obtained.

(b) Potassium Hydroxide Solution 7.0 g of potassium hydroxide (JIS special grade) is dissolved in 5 mL of ion-exchanged water. Then, ethyl alcohol (95 vol %) is added to make a volume of 1 L. The solution is placed in an alkali resistive container to avoid contact with carbon dioxide. After leaving it for 3 days, the solution is filtered to obtain a potassium hydroxide solution. The standardization is done based on the description in JIS K0070-1966.

(Main Test)

2.0 g of the pulverized sample is accurately weighted and placed in a 200 mL conical flask. Then, 100 mL of mixed solvent of toluene and ethanol (2:1) is added in the conical flask, and the sample is dissolved over a period of 5 hours.

Subsequently, several drops of the phenolphthalein solution are added as an indicator. The solution of the sample is titrated with the potassium hydroxide solution. The end point of the titration is made at the point that the pale red color of the indicator is remained for about 30 seconds.

(Blank Test)

The same titration as described above is done without using the sample (namely, only the mixed solvent of toluene an ethanol (2:1) is used for titration).

An acid value is calculated by substituting the obtained results in the following relation (1).

$$A=[(C-B)\times f\times 5.6]/S \qquad \text{Relation (1):}$$

The characters in the relation mean the following.

A: Acid value (mg KOH/g)

B: Added amount (mL) of potassium hydroxide solution in the blank test.

C: Added amount (mL) of potassium hydroxide solution in the main test.

f: Factor of 0.1 mol/L potassium hydroxide ethanol solution

S: Mass (g) of sample.

The crystalline polyester resin preferably has a weight average molecular weight (Mw) in the range of 5,000 to 50,000, and it preferably has a number average molecular weight (Mn) in the range of 1,500 to 25,000. The weight average molecular weight (Mw) and the number average molecular weight (Mn) of the crystalline polyester resin may be measured with the above-described GPC.

A melting point (Tm) of the crystalline polyester resin is preferably in the range of 55 to 90° C., more preferably in the range of 70 to 85° C. from the viewpoint of obtaining a sufficient low-temperature fixing property and hot offset resistance.

The melting point of the crystalline polyester resin may be controlled by the resin composition.

A melting point (Tm) is a peak top temperature in an endothermic curve. It may be measured with DSC.

Specific measurement is done as follows. A measuring sample is sealed in an aluminum pan (KIT NO.B0143013), and the sealed sample is set in a sample holder of a calorimeter "Diamond DSC" (PerkinElmer Inc.). The temperature is changed in the order of heating-cooling-heating. In the first heating step, the temperature is increased from room temperature (25° C.), and in the second heating step, the temperature is increased from 0° C. In both heating steps, the temperature is raised to 150° C. at a heating rate of 10° C./min, then the temperature is kept at 150° C. for 5 minutes. In the cooling step, the temperature is decreased from 150° C. to 0° C. at a cooling rate of 10° C./min. Then the temperature is kept at 0° C. for 5 minutes. A shift of a base line in the measurement curve obtained in the second heating is observed. A peak top temperature in an endothermic curve obtained in the second heating step is measured as a melting point.

<Coloring Agent>

In the present invention, the toner particles may use a coloring agent by combining widely known pigments and dyes. As a coloring agent, it may be used a yellow pigment for suitably producing a yellow toner excellent in a low-temperature fixing property with suppressed toner scattering.

From the viewpoint of obtaining an excellent coloring power with a small amount of coloring agent, it is preferable to use C. I. Pigment Yellow 74 as a pigment for a yellow toner. By using this pigment, it is possible to reduce the content of the coloring agent. As a result, the incorporating capacity of the coloring agent in the toner particles will be increased, toner scattering will be restrained, and an excellent low-temperature fixing property will be obtained through control of a filler effect.

From the viewpoint of obtaining a required hue and high coloring power as a coloring agent for a yellow toner, it is preferable to use C. I. Pigment Yellow 74 together with at least one pigment selected from the group consisting of: C. I. Pigment Yellow 93, C. I. Pigment Yellow 155, C. I. Pigment Yellow 180, C. I. Pigment Yellow 185, C. I. Solvent Yellow 93 and C. I. Solvent Yellow 163.

A content of these co-used pigment is preferably in the range of 5 to 5060 mass %, more preferably, in the range of 510 to 3040 mass % with respect to 100 mass % of C. I. Pigment Yellow 74 from the viewpoint of obtaining high coloring power and preventing decreased charging property.

A known dye and organic pigment may be combined to use as a coloring agent other than the above-described yellow pigments. Examples of an organic pigment are: C. I. Pigment Reds 5, 48: 1, 53: 1, 57: 1, 81: 4, 122, 139, 144, 149, 166, 177, 178, 222, 238, and 269; C. I. Pigment Yellows 14, 17, 94, and 138; C. I. Pigment Oranges 31 and 43; and C. I. Pigment Blues 15: 3, 60, and 76. Examples of a dye are: C. I. Solvent Reds 1, 49, 52, 58, 68, 11, and 122; C. I. Solvent Yellows 19, 44, 77, 79, 81, 82, 98, 103, 104, 112, and 162; and C. I. Solvent Blues 25, 36, 69, 70, 93, and 95.

A content of the coloring agent is preferably in the range of 1 to 20 mass parts, more preferably, in the range of 2 to 15 mass parts with respect to 100 mass parts of the binder resin.

<Alkoxy Aniline>

A content of alkoxy aniline in the toner particles according to the present invention is in the range of 0.1 to 15.0 mass ppm.

The toner of the present invention contains alkoxy aniline with the content of the above-described range. As a result of this, alkoxy aniline that carries a positive electric charge will enclose the releasing agent and the crystalline resin both having a negative electric charge. Consequently, the same components of the releasing agent and the crystalline resin are hardly gathered respectively.

Further, when the releasing agent domains are uniformly dispersed in the toner particles, the releasing agent domains are located among the crystalline resin domains. As a result, the crystalline resin domains are hardly gathered together. By this, the dispersing property of the crystalline resin domains in the toner particles is extremely improved, and it may be obtained a toner excellent in low-temperature fixing property.

When the content of alkoxy aniline is 0.1 mass ppm or more, it may be obtained a toner having an improved low-temperature fixing property. When the content is 15.0 mass ppm or less, an amount of the positive electric charge in the toner particles may be controlled to prevent lowering of toner charging power. Thus, the toner scattering due to lowered toner charging power may be restrained.

The content of alkoxy aniline in the toner particles may be adjusted by adding alkoxy aniline.

The above-described C. I. Pigment Yellow 74 may originally contain alkoxy aniline. In this case, the content of alkoxy aniline in the pigment is specified beforehand. Then, the content of alkoxy aniline in the toner particles may be adjusted to be in the range of 0.1 to 15.0 mass ppm by making pre-treatment such as heating or vacuum degassing to the pigment.

The above-described alkoxy aniline may have an alkoxy group containing a straight or branched chain alkyl portion. From the viewpoint of restraining plasticizing of the amorphous resin, it is preferable that the alkyl portion has a carbon atom number of 1 to 6. Among them, it is particularly preferable to contain 2-methoxy aniline. By restraining plasticizing of the amorphous resin, it can restrain lowering of the charging property and fluidity of the toner. Further, two or more kinds of alkoxy anilines may be co-used.

(Measuring Method of Alkoxy Aniline)

5 mg of toner sample is placed in a container (160 mL of volume) of an out gas collecting apparatus HM-04 (made by Japan Analytical Industry Co. Ltd.). While flowing a nitrogen gas at a flow rate of 200 mL/min, the temperature is raised from room temperature to 120° C. over a period of 10 min. The sample is kept at 120° C. for 50 min. The out gas emitted from the sample is collected with a heat-desorption collecting tube (AERO TDGL-Tube, made by GL Science Co. Ltd.) loaded with Tenax-GR as a primary adsorbing tube. Then, by using a heat-desorption apparatus JTD 505 (made by Japan Analytical Industry Co. Ltd.), the primary adsorbing tube is heated to 250° C. to collect the adsorbed gas to the primary adsorbing tube is collected by condensing to the secondary adsorbing tube cooled at −40° C.

A gas chromatography mass spectrometer GCMS-QP2010 (made by Shimadzu Co. Ltd.) is used for the measurement. The secondary adsorbing tube having collected the gas is hated to 280° C. with a Curie point method to carry out qualitative and quantitative analysis from MS (mass) and the peak area. A quantitative analysis of alkoxy aniline is done based on the calibration curve prepared beforehand from the mass and the peak area.

As a GC/MS column, it is used HP-1 MS (made by Agilent Technology Co. Ltd.) (length of 60 m, film pressure of 0.25 μm, and inner diameter of 0.25 mm). The temperature conditions of the column are as follows: it is kept at 40° C. for 4 min, then it is raised to 140° C. at a rate of 5° C./min, then it is raised to 240° C. at a rate of 10° C./min, then further it is raised to 290° C. at a rate of 25° C./min, and it is kept at 290° C. for 3 min.

<Releasing Agent>

A releasing agent used in the present invention is not limited in particular. A variety of known waxes may be used. Examples of usable wax are: polyolefin waxes such as polyethylene wax and polypropylene wax; branched chain hydrocarbon wax such as microcrystalline wax; long chain hydrocarbon waxes such as paraffin wax and Sasol wax; dialkyl ketone wax such as distearyl ketone; ester waxes such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristeary trimellitate, and distearyl maleate; and amide waxes such as ethylenediamine behenyl behenate and tristearyamide trimellitate.

A melting point of the releasing agent is preferably in the range of 60 to 90° C. By this, the releasing agent may be easily maintained in a dispersed condition in the toner particles during production of the toner. It may be restrained exposure of the releasing agent on the surface of the toner particle. Further, as a result of improved compatibility between the releasing agent and the crystalline resin, it can adjust the compatibility property between the amorphous resin and the crystalline resin.

A content of the releasing agent in the toner is usually in the range of 1 to 30 mass % with respect to 100 mass parts of the binder resin. More preferably, it is in the range of 5 to 20 mass %. By making the content of the releasing agent in the above-described range, it may be obtained sufficient fixing-separation property.

A content of the releasing agent in the toner particles is preferably in the range of 3 to 15 mass %.

<Charge Controlling Agent>

As a charge controlling agent, it may be used the following known compounds. Examples thereof are: Nigrosine dyes, metal salts of naphthenic acid, metal salts of higher fatty acids, alkoxy amines, quaternary ammonium salts, azo type metal complexes, and salicylic acid metal salts. By adding a charge controlling agent, it can obtain a toner excellent in charge controlling property.

A content of the charge controlling agent in the toner is preferably in the range of 0.1 to 5.0 mass parts with respect to 100 mass parts of the binder resin in the toner.

<External Additive>

The toner particles of the present invention may be directly used for the toner. However, in order to improve fluidity, charging property, and cleaning property of the toner, it may be added an external additive such as fluidity increasing agent and cleaning assisting agent.

Examples of an external additive are: inorganic oxide fine particles such as silica fine particles, alumina fine particles, and titanium oxide fine particles; inorganic stearic acid compound fine particles such as aluminum stearate fine particles and zinc stearate fine particles; and inorganic titanium acid compound fine particles such as strontium titanate fine particles and zinc titanate fine particles. These may be used alone, or they may be used in combination of two or more kinds.

From the viewpoint of improving heat-resisting storage stability and environmental stability, these external additives may be subjected to a surface glossing treatment by using a silane coupling agent, a titan coupling agent, a higher aliphatic acid, or a silicone oil.

An added amount of the external additive (the total amount of the external additives when a plurality of external additives are used) is preferably in the rage of 0.05 to 5 mass parts with respect to 100 mass parts of toner particles. More preferably, it is in the rage of 0.1 to 3 mass parts.

<Core-Shell Structure>

The toner particles may be used without modification. However, they may have a multi-layered structure such as a core-shell structure (a morphology in which a shell layer is formed on the surface of the toner particle used as a core particle).

Here, the core-shell structure is not limited to a structure in which the shell layer completely covers the core particle. It includes a structure in which a part of the core particle is exposed.

The cross-sectional structure of the core-shell structure may be observed and confirmed with a known method such as a transmission electron microscope (TEM) or a scanning probe microscope (SPM).

In the case of the core-shell structure, the core particle and the shell layer each may have different glass transition point, melting point, and hardness. As a result, it is possible to make a toner design corresponding to the purpose. For example, a shell layer may be formed by aggregated and fused a resin having a high glass transition point (Tg) on the surface of a core particle containing a binder resin, a coloring agent and a releasing agent, and having a low glass transition point (Tg). Preferably, the shell layer contains an amorphous resin.

<Average Particle Size of Toner Particles>

It is preferable that the toner particles of the present invention have an average particle size of, for example, 3 to 10 μm, more preferably 5 to 8 μm in volume-based median diameter ($d_{50}$). When the volume-based median diameter ($d_{50}$) is within the above-described range, the minute dot image of 1200 dpi level may be faithfully reproduced.

The average particle size of the toner particles may be controlled by changing the concentration of the coagulant agent, the added amount of organic solvent, fusing time, the composition of the binder resin used in the production.

The volume-based median diameter ($d_{50}$) of the toner is measured and calculated by using measuring equipment composed of a "MULTISIZER 3" (Beckman Coulter Inc.) and a computer system installed with data processing software "Software V3.51" connected thereto. Specifically, a predetermined amount of a measuring sample (toner) is added to a predetermined amount of surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion. The toner dispersion thus prepared is added to "ISOTON II" (Beckman Coulter Inc.) in a beaker placed in sample stand by a pipet until the concentration displayed on the measuring equipment reaches 8%. Within this concentration range, reproducible measurement values may be obtained. The measuring particle count and the aperture size of the measuring equipment are set to 25,000 and 100 μm respectively. The measuring range, which is from 2 to 60 μm, is divided into 256 sections to calculate the respective frequencies. The particle size where the accumulated volume counted from the largest size reaches 50% is determined as the volume-based median diameter ($d_{50}$).

<Average Circularity of Toner Particles>

It is preferable that the toner particles in the toner of the present invention have an average circularity of 0.930 to 1.000, more preferably 0.950 to 0.995 in terms of the stability of the charging characteristics and increasing the low-temperature fixability.

When the average circularity is within the above-described range, the individual toner particles are less crushable. This prevents the triboelectric charge applying member from smudges and it stabilizes the charging characteristics of the toners. Further, high quality images may be formed.

In the present invention, the average circularity of the toner particles may be obtained by measurement with an "FPIA-2100" (Sysmex Corp.).

Specifically, a measuring sample (toner particles) is mixed with an aqueous solution containing a surfactant and is further dispersed by ultrasonic treatment for 1 minute. Thereafter, photographs are taken by means of the "FPIA-2100" (Sysmex Corp.) in the conditions of the HPF (high power imaging) mode at an adequate concentration corresponding to an HPF detect number of 3,000 to 10,000. The average circularity of the toner is calculated by determining the circularity of each toner particle according to the following Relation (I) and dividing the sum of the circularities of the individual toners by the total number of toner particles.

Circularity of toner particle=(Circumference of circle having same area as projected image of particle)/(Perimeter of projected image of particle) Relation (I):

<Developer>

The electrostatic image developing toner of the present invention may be used as a magnetic or non-magnetic single-component toner, or it may be used as a double-component developer by mixing with a carrier. When the toner of the present invention is used as a double-component developer, as a carrier constituting the double-component developer, there may be utilized magnetic particles composed of materials conventionally known in the art including metals such as iron, ferrite, and magnetite, or alloys of these metals with aluminum or lead. Specifically, ferrite particles are preferable.

As a carrier, there may be utilized a coated carrier prepared by coating the magnetic particles with a resin, or a resin dispersion type carrier prepared by dispersing magnetic particles in a resin.

The volume-based median diameter ($d_{50}$) of the carrier is preferably 20 to 100 μm, it is more preferably 25 to 80 μm. It is possible to determine the volume-based median diameter ($d_{50}$) of the carrier by using laser diffraction system particle size distribution meter "HELOS" (produced by SYMPATEC Co.) provided with a wet type dispersing apparatus.

[Production Method of Electrostatic Image Developing Toner]

As production methods of an electrostatic image developing toner according to the present invention, it may be cited: a suspension polymerization method, an emulsion aggregation method, and other method. Among them, it is preferable to use an emulsion aggregation method. By using this emulsion aggregation method, it may easily achieve a toner having toner particles of a small size in view of the production cost and the production stability.

The production method of toner particles by the emulsion aggregation method includes the following steps: mixing an aqueous dispersion liquid of amorphous resin particles, an aqueous dispersion liquid of crystalline resin particles, and an aqueous dispersion liquid of coloring agent particles; then aggregating the amorphous resin particles, the crystalline polyester resin particles, and the coloring agent particles, to form toner particles.

An example of a preparation method of a toner by an emulsion aggregation method is described in the following.

Step (1)

In this step (1), an aqueous dispersion liquid of amorphous polyester resin particles is prepared as a dispersion liquid of an amorphous resin. Here, when two types of amorphous resins are used (one is an amorphous polyester resin (high molecular component) having a high weight average molecular weight (Mw) and the other is an amorphous polyester resin (low molecular component) having a low weight average molecular weight (Mw)), two dispersion liquids of the amorphous polyester resin are separately prepared.

Specifically, an amorphous polyester resin is prepared, then, this resin is dissolved or dispersed in an organic solvent to form an oil phase. The produced oil phase is phase-transfer emulsified to disperse amorphous polyester resin particles in an aqueous medium. After controlling the particle size of the oil droplets to achieve a required particle size, the organic solvent is removed. Thus an aqueous dispersion liquid of amorphous polyester resin particles is prepared.

As an organic solvent used for the preparation of the oil phase liquid, it is preferable that the solvent has a low boiling point and a small solubility in water from the viewpoint of easily removing the solvent after formation of the oil droplets. Specific examples of a solvent are: methyl acetate, ethyl acetate, methyl ethyl ketone, methyl isobutyl ketone, toluene, and xylene. These may be used alone, or they may be used in combination of two or more kinds.

An amount of the used organic solvent is usually in the range of 1 to 300 mass parts with respect to 100 mass parts of amorphous polyester resin.

The emulsion dispersion of the oil phase liquid may be done by making use of mechanical energy.

Step (2)

In this step (2), an aqueous dispersion liquid of crystalline resin particles is prepared. In the following explanation, it is described the case in which a crystalline polyester resin is used for a crystalline resin.

The aqueous dispersion liquid of crystalline resin particles is prepared in the same manner as preparation of the aqueous dispersion liquid of amorphous polyester resin.

An average particle size of crystalline polyester resin particles is preferably in the range of 100 to 400 nm in a volume-based median diameter ($d_{50}$). The volume-based median diameter ($d_{50}$) of the crystalline polyester resin particles may be measured with "Microtrac UPA-150" (made by Nikkiso Co., Ltd.).

Step (3)

In this step (3), a coloring agent is dispersed in an aqueous medium in fine particles to prepare an aqueous dispersion of coloring agent particles. Further, in this step, alkoxy aniline is added so that a content of alkoxy aniline in the toner particles becomes in the range of 0.1 to 15.0 mass ppm. Here, when the pigment used as a coloring agent already contains alkoxy aniline, and when it is required to reduce the content of alkoxy aniline to the above-described range, the content may be adjusted by making pre-treatment such as heating or vacuum degassing to the pigment.

The aqueous dispersion liquid of coloring agent particles may be obtained by dispersing a coloring agent into an aqueous medium containing a surface-active agent in an amount of larger than a critical micelle concentration (CMC).

The dispersion of the coloring agent may be done by making use of mechanical energy. A dispersion apparatus is not limited in particular. Preferable examples thereof are: pressurized dispersing machines such as an ultrasonic dispersing machine, a mechanical homogenizer, a Manton-Gaulin homogenizer, and a pressure type homogenizer; and media type dispersing machines such as a sand grinder, a Getzman mill, and a diamond fine mill.

It is preferable that the dispersed coloring agent particles in the aqueous dispersion liquid have a volume-based median diameter ($d_{50}$) in the range of 10 to 300 nm, more preferably in the range of 100 to 200 nm, and still more preferably in the range of 100 to 150 nm.

The volume-based median diameter ($d_{50}$) of the crystalline polyester resin particles may be measured with "Microtrac UPA-150" (made by Nikkiso Co., Ltd.).

Step (4)

In this step (4), toner particles are formed by aggregating particles of toner constituting components: amorphous resin particles, crystalline polyester resin particles, coloring agent particles, and other additives.

Specifically, a coagulant is added to an aqueous dispersion liquid dispersed with the above-described particles in an amount of larger than the critical aggregation concentration. Then, the temperature of the liquid is made to be higher than the glass transition temperature (Tg) of the amorphous resin particles. Thus, the aggregation is done.

(Coagulant)

The coagulant used in this step is not limited in particular, but it is preferably selected from metal salts of alkali metal salts and alkali earth metal salts. Such metal salts include, for example, monovalent metal salts such as salts of sodium, potassium and lithium; divalent metal salts of calcium, magnesium, manganese and copper; and trivalent metal salts of iron and aluminum. Specific examples of such metal salts include sodium chloride, potassium chloride, lithium chloride, calcium chloride, magnesium chloride, zinc chloride, copper sulfate, magnesium sulfate, and manganese sulfate. Among them, divalent metal salts are particularly preferred since the aggregation is caused by a smaller amount. These coagulants may be used alone, or they may be used in combination of two or more kinds.

Step (5)

In this step (5), toner particles formed by the step (4) are aged to change the shape of the toner particles into a required shape. This step is done according to necessity.

Specifically, the dispersion liquid of the toner particles formed by the step (4) is heated with stirring. The heating temperature, stirring speed and heating time are controlled so that the average circularity of the aggregated particles reaches a desired level.

Step (4B)

In this step (4B), the toner particles obtained in the step (4) or the step (5) are used as core particles. A shell layer is formed on the core particle so that at least a part of the surface of the core particle is covered. The step (4B) is done only when toner particles having a core-shell structure are produced.

When toner particles having a core-shell structure are produced, they may be produced by the following method. A resin that constitutes a shell layer is dispersed in an aqueous medium to prepare a dispersion liquid of resin particles for a shell layer. This dispersion liquid for a shell layer is added to the dispersion liquid of the toner particles obtained in the step (4) or the step (5). The resin particles for a shell layer are aggregated and fused on the surface of the toner particles. By this, it may be obtained a dispersion liquid of toner particles having a core-shell structure.

For the purpose of more strongly aggregating and fusing the resin particles for a shell layer on the core particles, a heating treatment may be done after the shell forming step.

The heating treatment may be done until the moment of obtaining toner particles reaching a required circularity.

Step (6)

In this step (6), the dispersion liquid of toner particles is cooled. As a condition of cooling treatment, it is preferable to cool the dispersion liquid at a cooling rate of 1 to 20° C./min. A specific cooling method is not limited in particular. It may be cited: a cooling method of introducing a coolant from the outside of the reaction vessel; and a cooling method of directly introducing water into a reaction system.

Step (7)

In this step (7), the toner particles are separated from the cooled dispersion liquid of toner particles through a solid-liquid separation method. The adhered materials such as a surfactant and a coagulant on the obtained toner cake (an assembled body having a shape of a cake made of wet toner particles) are removed and washed out.

A solid-liquid separation method is not limited in particular. It may be used: a centrifugation method, a reduced filtration method using an apparatus such as a Buchner funnel, a filtration method using an apparatus such as a filter press. For washing, it is preferable to wash the toner cake with water until the condition of achieving the electric conductivity of the filtrate to be 10 μS/cm.

Step (8)

In this step (8), the washed toner cake is dried.

Specific examples of a dryer used for drying the toner cake are: a spray drier, a vacuum freeze dryer, and a vacuum dryer. It is preferable to use an apparatus such as a static shelf dryer, a mobile shelf dryer, a fluidized bed dryer, a rotary dryer, and a stirring dryer.

A content of water in the dried toner particles is preferably 5 mass % or less, more preferably, it is 2 mass % or less.

When the dried toner particles each are aggregated by a weak particle attraction, it may be broken the aggregate. As a breaking apparatus, it may be cited: a mechanical mixing machine such as Jet mill, Henschel mixer, a coffee mill, and a food processor.

Step (9)

In this step (9), an external additive is added to the toner particles. The step (9) is done according to need.

As a mixing apparatus of an external additive, it may be used a mixing apparatus such as a Henschel mixer, a coffee mill, or a food processor.

EXAMPLES

Hereinafter, specific examples of the present invention will be described, but the present invention is not limited thereto. In the present examples, the description of "parts" or "%" is used, it represents "mass parts" or "mass %" unless specific notice is given.

<Synthesis of Crystalline Polyester Resin (C1)>

Into a 5 L reaction vessel equipped with a stirrer, a temperature sensor, a cooling tube, and a nitrogen introducing device, were added 281 mass parts of tetradecanedioic acid and 206 mass parts of 1,6-hexanediol. The temperature of the reaction mixture was raised to 190° C. over a period of 1 hour. After confirming that the reaction system was uniformly stirred, 0.003 mass % of $Ti(OBu)_4$ was added as a catalyst with respect to 100 mass % of tetradecanedioic acid, then, the temperature of the reaction mixture was raised from 190° C. to 240° C. over a period of 6 hours while removing the produced water. Further, with keeping the temperature at 240° C., the dehydration-condensation reaction was continued to perform polymerization. Thus it was obtained a crystalline polyester resin (c1).

The obtained crystalline polyester resin (C1) had a number average molecular weight (Mn) of 4,400 and an acid value of 20 mg KOH/g. The acid value of the crystalline polyester resin was measured based on the method described in JIS K0070-1966. The acid values of the following crystalline polyester resins were measured in the same way.

<Synthesis of Crystalline Polyester Resin (C2)>

The crystalline polyester resin (C2) is a hybrid crystalline polyester resin, and it was synthesized as follows.

| (Preparation of crystalline polyester resin segment (CPEs)) | |
|---|---|
| Adipic acid | 330 mass parts |
| Ethylene glycol | 45 mass parts |
| 1,4-Butanediol | 135 mass parts |

The above-described raw monomers for a crystalline polyester resin segment (CPEs) were introduced in a four-necked flask equipped with a nitrogen introducing tube, a dehydration tube, a stirrer, and a thermocouple. Then, the mixture was heated to 170° C. to dissolve the content. Then, $Ti(OBu)_4$ was added as an esterification catalyst (0.003 mass % with respect to the total amount of the polycarboxylic acid monomer). While keeping the temperature of the mixture at 170° C., the reaction was made for 5 hours with removing the produced water. Then, after the reaction was further made for 60 minutes, the unreacted monomers were removed under a reduced pressure (8 kPa).

(Preparation of Amorphous Polyester Resin Segment (APEs))

Into a reaction vessel equipped with a stirrer, a nitrogen introducing tube, a temperature sensor, and a rectifying column were placed the following raw monomers for the amorphous polyester resin segment (APEs). The temperature of the reaction mixture was raised to 190° C. over a period of 1 hour. Then, it was confirmed that the reaction system was uniformly stirred. Afterward, $Ti(OBu)_4$ was added as an esterification catalyst (0.003 mass % with respect to the total amount of the polycarboxylic acid monomers). While keeping the temperature of the mixture at 190° C., the reaction was made for 5 hours with removing the produced water.

| (Preparation of hybrid crystalline polyester resin) | |
|---|---|
| (Polycarboxylic acid monomers) | |
| Terephthalic acid (TPA) | 3.3 mass parts |
| Fumaric acid (FA) | 0.3 mass parts |
| Trimellitic acid (TMA) | 0.6 mass parts |
| (Polyhydric alcohol monomers) | |
| 2,2-bis(4-phydroxyohenyl)propane-ethylene oxide adduct (1:2) (BPA-EO) | 2.1 mass parts |
| 2,2-bis(4-phydroxyohenyl)propane-propylene oxide adduct (1:2) (BPA-PO) | 6.9 mass parts |

Into the reaction vessel in which the above-described crystalline polyester resin segment (CPEs) was prepared were added 0.8 mass parts of $Ti(OBu)_4$ as an esterification catalyst and the above-described amorphous polyester resin segment (APEs). The temperature of the mixture was raised to 235° C. The reaction was made under a normal pressure (101.3 kPa) for 5 hours, then further, the reaction was made under a reduced pressure (8 kPa) for 1 hour.

Then, after cooling the mixture to 200° C., the reaction was made under a reduced pressure (20 kPa) for 1 hour. By this, it was obtained a crystalline polyester resin (C2) that was a hybrid crystalline polyester resin.

The crystalline polyester resin (C2) had a number average molecular weight (Mn) of 7,500 and an acid value of 25 mg KOH/g.

<Synthesis of Amorphous Polyester Resin (A1)>

Into a reaction vessel equipped with a stirrer, a nitrogen introducing tube, a temperature sensor, and a rectifying column were placed the following polycarboxylic acid monomers and polyhydric alcohol components. The temperature of the reaction mixture was raised to 190° C. over a period of 1 hour. Then, it was confirmed that the reaction system was uniformly stirred. Afterward, $Ti(OBu)_4$ was added as an esterification catalyst (0.004 mass % with respect to the total amount of the polycarboxylic acid monomers). The temperature of the reaction mixture was raised from 190° C. to 240° C. over a period of 6 hours with removing the produced water. The polymerization reaction was done by continuing the dehydration-condensation reaction at 240° C. for 10 hours. Then, the reaction mixture was subjected to a reduced pressure to obtain an amorphous polyester resin (A1). The obtained resin had a weight average molecular weight (Mw) of 68,000 and an acid value of 15 mg KOH/g. The acid value of the amorphous polyester resin was measured based on the method described in JIS K0070-1992. The acid values of the following amorphous polyester resins were measured in the same way.

| <Synthesis of amorphous polyester resin (B1)> | |
|---|---|
| (Polycarboxylic acid monomers) | |
| Terephthalic acid (TPA) | 15 mass parts |
| Fumaric acid (FA) | 30 mass parts |
| Dodecenyl succinic acid (DDSA) | 3 mass parts |
| Trimellitic acid (TMA) | 10 mass parts |
| (Polyhydric alcohol monomers) | |
| 2,2-bis(4-hydroxyohenyl) propane-ethylene oxide adduct (1:2) (BPA-EO) | 20 mass parts |
| 2,2-bis(4-hydroxyohenyl) propane-propylene oxide adduct (1:2) (BPA-PO) | 70 mass parts |

Into a reaction vessel equipped with a stirrer, a nitrogen introducing tube, a temperature sensor, and a rectifying column were placed the following polycarboxylic acid monomers and polyhydric alcohol components. The temperature of the reaction mixture was raised to 190° C. over a period of 1 hour. Then, it was confirmed that the reaction system was uniformly stirred. Afterward, $Ti(OBu)_4$ was added as an esterification catalyst (0.004 mass % with respect to the total amount of the polycarboxylic acid monomers). The temperature of the reaction mixture was raised from 190° C. to 240° C. over a period of 6 hours with removing the produced water. The polymerization reaction was done by continuing the dehydration-condensation reaction at 240° C. for 6 hours. Then, the reaction mixture was subjected to a reduced pressure to obtain an amorphous polyester resin (B1). The obtained resin had a weight average molecular weight (Mw) of 21,000

| <Preparation of dispersion liquid of releasing agent particles (W1)> | |
|---|---|
| (Polycarboxylic acid monomers) | |
| Terephthalic acid (TPA) | 60 mass parts |
| Dodecenyl succinic acid (DDSA) | 5 mass parts |
| Trimellitic acid (TMA) | 7 mass parts |

-continued

| <Preparation of dispersion liquid of releasing agent particles (W1)> | |
|---|---|
| (Polyhydric alcohol monomers) | |
| 2,2-bis (4-phydroxyohenyl) propane-ethylene oxide adduct (1:2 ) (BPA-EO) | 30 mass parts |
| 2,2-bis (4-phydroxyohenyl) propane-propylene oxide adduct (1:2) (BPA-PO) | 60 mass parts |

Hydrocarbon wax (paraffin wax, HNP-11, made by Nippon Seiro Co., Ltd., melting point of 70° C.): 270 mass parts Anionic surfactant (Neogen RK, made by DKS Co. Ltd., effective content of 60 mass %): 13.5 mass parts (as an effective component, 3.0 mass % with respect to the releasing agent)

Ion-exchanged water: 21.6 mass parts

The above-described components were mixed. Then, the paraffin wax (releasing agent) was melted in a pressure discharge type Gaulin homogenizer (made by Gaulin Co. ltd.) at an inner temperature of 120° C. Afterward, the mixture was subjected to a dispersion treatment at a dispersion pressure of 5 MPa for 120 minutes, then it was treated at a dispersion pressure of 40 MPa for 360 minutes. Then, the mixture was cooled to obtain a dispersion liquid of releasing agent particles (W1). The dispersion liquid (W1) contained particles having a volume-based median diameter d50 of 225 nm. Subsequently, ion-exchanged water was added to adjust the solid content to be 20.0 mass %.

<Preparation of Dispersion Liquids of Releasing Agent Particles (W2) to (W4)>

Dispersion liquids of releasing particles (W2) to (W4) each were prepared in the same manner as preparation of the dispersion liquid of releasing particle (W1) except that the hydrocarbon wax used as a releasing agent was changed as indicated below.

Dispersion liquid of releasing agent particles (W2): Micro crystalline wax (HNP-0190, made by Nippon Seiro Co., Ltd., melting point of 85° C.)

Dispersion liquid of releasing agent particles (W3): Fischer-Tropsch wax (FNP-0090, made by Nippon Seiro Co., Ltd., melting point of 80° C.)

Dispersion liquid of releasing agent particles (W4): Ester wax (WEP-3, made by Nippon Seiro Co., Ltd., melting point of 73° C.)

<Preparation of Dispersion Liquid of Crystalline Resin (Crystalline Polyester Resin) Particles (CA-1)>

100 mass parts of the crystalline polyester resin (C1) were dissolved in 400 mass parts of ethyl acetate. Then, 25 mass parts of 5 mass % sodium hydroxide aqueous solution were added to make a resin solution. This resin solution was placed in a reaction vessel equipped with a stirrer. While stirring the resin solution, 400 mass parts of 0.26 mass % sodium lauryl sulfate aqueous solution were added over a period of 30 minutes. On the way of adding the sodium lauryl sulfate aqueous solution, the liquid in the reaction vessel became cloudy. All amount of the sodium lauryl sulfate aqueous solution was dropped, and it was obtained an emulsion dispersion liquid in which were uniformly dispersed the crystalline polyester resin particles containing 20% of solid fraction.

<Preparation of Dispersion Liquid of Crystalline Resin (Crystalline Polyester Resin) Particles (CA-2)>

A dispersion liquid of crystalline resin particles (CA-2) was prepared in the same manner as preparation of the dispersion liquid of crystalline resin particles (CA-1) except that the kind of the crystalline polyester resin was changed from C1 to C2.

<Preparation of Dispersion Liquid of Amorphous Polyester Resin Particles (AA-1)>

A dispersion liquid of amorphous resin particles (AA-1) was prepared in the same manner as preparation of the dispersion liquid of crystalline resin particles (CA-1) except that the crystalline polyester resin (C1) was changed to the amorphous polyester resin (A1).

<Preparation of Dispersion Liquid of Amorphous Polyester Resin Particles (BA-1)>

A dispersion liquid of amorphous resin particles (BA-1) was prepared in the same manner as preparation of the dispersion liquid of crystalline resin particles (CA-1) except that the crystalline polyester resin (C1) was changed to the amorphous polyester resin (B1).

<Preparation of Dispersion Liquid of Coloring Agent Particles (P1)>

(Pre-Treatment)

As a pigment of a coloring agent, C. I. Pigment Yellow 74 was arranged. This pigment was subjected to a pre-treatment of a vacuum heat treatment under the conditions of temperature 100° C. and a vacuum level of 13.3322 Pa.

(Dispersion)

90 mass parts of sodium lauryl sulfate were added to 1,600 mass parts of ion-exchanged water. While stirring this solution, 220 mass parts of the pre-treated C. I. Pigment Yellow 74 were gradually added. Subsequently, the solution was subjected to a dispersion treatment using a stirrer "CLEARMIX" (M Technique Co., Ltd.). Thus a dispersion liquid of coloring agent particles (P1) was obtained. The solid fraction of this dispersion liquid (P1) was 13.0%. A volume-based median diameter of the colorant agent particles in the dispersion liquid was 160 nm. A content of alkoxy aniline (2-methoxy aniline) in C. I. Pigment Yellow 74 was measured to be 300 mass ppm.

<Preparation of Dispersion Liquid of Coloring Agent Particles (P2)>

A dispersion liquid of coloring agent particles (P2) was obtained in the same manner as preparation of the dispersion liquid of coloring agent particles (P1) except that the coloring agent was changed to a mixture of C. I. Pigment Yellow 74 and C. I. Pigment Yellow 155 with a mass ratio of 1:0.4, wherein C. I. Pigment Yellow 155 was subjected to the same pre-treatment as done to C. I. Pigment Yellow 74.

<Preparation of Dispersion Liquid of Coloring Agent Particles (P3)>

A dispersion liquid of coloring agent particles (P3) was obtained in the same manner as preparation of the dispersion liquid of coloring agent particles (P1) except that the coloring agent was changed to C. I. Pigment Yellow 74 without subjected to the pre-treatment as described above.

<Preparation of Dispersion Liquid of Coloring Agent Particles (P4)>

A dispersion liquid of coloring agent particles (P4) was obtained by adding 80 mass parts of 2-ethoxy aniline to the dispersion liquid of coloring agent particles (P1).

<Preparation of Dispersion Liquid of Coloring Agent Particles (P5)>

A dispersion liquid of coloring agent particles (P5) was obtained in the same manner as preparation of the dispersion liquid of coloring agent particles (P1) except that the coloring agent was changed to C. I. Pigment Yellow 155 without subjected to the pre-treatment as described above in place of C. I. Pigment Yellow 74, and further by adding 200 mass parts of 2-methoxy aniline.

<Preparation of Dispersion Liquid of Coloring Agent Particles (P6)>

A dispersion liquid of coloring agent particles (P6) was obtained in the same manner as preparation of the dispersion liquid of coloring agent particles (P1) except that the coloring agent was changed to C. I. Pigment Yellow 155 without subjected to the pre-treatment as described above in place of C. I. Pigment Yellow 74.

<Preparation of Dispersion Liquid of Coloring Agent Particles (P7)>

A dispersion liquid of coloring agent particles (P7) was obtained in the same manner as preparation of the dispersion liquid of coloring agent particles (P1) except that the coloring agent was changed to C. I. Pigment Yellow 155 without subjected to the pre-treatment as described above in place of C. I. Pigment Yellow 74, and further by adding 400 mass parts of 2-methoxy aniline.

In Table 1, there are listed the kinds of the coloring agents in the dispersion liquids of coloring agent particles (P1 to P7), the kind and the amount of the alkoxy aniline in the dispersion liquids. In Table 1, C. I. Pigment Yellow 74 is described as PY74, C. I. Pigment Yellow 155 is described as PY155, 2-methoxy aniline is described as MA, and 2-ethoxy aniline is described as EA.

<Preparation of Toner (1)>

Into a reaction vessel equipped with a stirrer, a temperature sensor and a cooling tube, 100 mass parts (in solid fraction) of the dispersion liquid of the amorphous polyester resin particles (AA-1), 80 mass parts (in solid fraction) of the dispersion liquid (BA-1) of the amorphous polyester resin particles, and 2,000 mass parts of ion-exchanged water were charged. Thereafter, while mixing the mixture at 20° C., the pH was adjusted to 10 by adding 5 mol/L sodium hydroxide aqueous solution.

Further, there were 6.2 mass parts (in solid fraction) of the dispersion liquid of the coloring agent particles (P1) were added. Then, while stirring, an aqueous solution of 60 mass parts of magnesium chloride dissolved in 60 mass parts of ion-exchanged water were added at 30° C. over a period of 10 minutes. After leaving the mixture for 3 minutes, 20 mass parts (in solid fraction) of the aqueous dispersion liquid of the crystalline polyester resin particles (CA-1) were added over a period of 10 minutes. Then, the temperature of the system was raised to 82° C. over a period of 60 minutes, and the temperature was held at 82° C. to allow the particle growth reaction to continue.

While keeping this condition, the particle size of the aggregated particles was measured by using a "Coulter Multisizer 3" (Beckman Coulter, Inc.). When the volume based median particle size reached 6.0 μm, an aqueous solution containing 190 mass parts of sodium chloride dissolved in 760 mass parts of ion-exchanged water was added to terminate the particle growth. Then, the reaction system was further stirred at 74° C. to allow fusion of the particles to proceed. When the average circularity of the toner reached 0.957, the reaction system was cooled to 30° C. at a cooling rate of 2.5° C./min. The average circularity of the toner was measured by a measuring apparatus "FPIA-2100" (Sysmex Corp.) (HPF detect number of 4,000).

Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to obtain toner mother particles.

To 100 mass parts of the obtained toner mother particles were added 0.6 mass parts of hydrophobic silica (number average primary particle size=12 nm, hydrophobicity=68)

and 1.0 mass parts of hydrophobic titanium oxide (number average primary particle size=20 nm, hydrophobicity=63). The mixture was blended by using a "Henschel mixer" (Nippon Coke & Engineering Co., Ltd.) with a rotary blade circumferential speed of 35 mm/sec at 32° C. for 20 minutes. Thereafter, the coarse particles were removed with a sieve having a mesh of 45 μm. Thus, it was prepared a toner (1) treated with an external additive.

<Preparation of Toners (2) to (12)>

Toners (2) to (12) each were prepared in the same manner as preparation of the toner (1) except that the combination of the dispersion liquids were changed as indicated in Table 1.

<Preparation of Electrostatic Image Developing Developers (1) to (12)>

100 mass parts of ferrite core and 5 mass parts of copolymer resin particles made of cyclohexyl methacrylate/methylmethacrylate (copolymerization ratio of 1:1) were placed in a high speed mixer provided with a stirring blade. The mixture was stirred at 120° C. from 30 minutes to form a resin coat layer on a surface of a ferrite core with a mechanical force effect. Thus it was obtained a carrier having a volume-based median diameter ($d_{50}$) of 35 μm.

The volume-based median diameter ($d_{50}$) of the carrier was measured by using a laser diffraction system particle size distribution meter "HELOS" (produced by SYMPATEC Co.) provided with a wet type dispersing apparatus. To the above-described carrier was added each of the toners (1) to (12) so that the content of the toner became to be 6 mass %. The mixtures each were loaded in a micro V-shape mixer (made bay Tsutsui Scientific Instrument Co. Ltd.), and they were mixed with a rotation rate of 45 rpm for 30 minutes to prepare developers (1) to (12).

| | Coloring agent | | | | | | | | | | |
|---|---|---|---|---|---|---|---|---|---|---|---|
| | Dispersion liquid | | | | Alkoxy aniline | | | | Crystaline polyester resin | | |
| | | | | | | Addition | | | | | |
| Toner number | Number | Kind | Amount of dispersion liquid (mass parts) | Pre-treatment | Kind in coloring agent | Kind | Added amount (mass ppm) | Total content (mass ppm) | Kind | Acid value (mg KOH/g | Content (mass %) |
| 1 | P1 | PY74 | 6.2 | Done | MA | — | — | 300 | C1 | 20 | 10 |
| 2 | P1 | PY74 | 6.2 | Done | MA | — | — | 300 | C1 | 20 | 10 |
| 3 | P1 | PY74 | 6.2 | Done | MA | — | — | 300 | C1 | 20 | 10 |
| 4 | P1 | PY74 | 6.2 | Done | MA | — | — | 300 | C1 | 20 | 10 |
| 5 | P1 | PY74 | 6.2 | Done | MA | — | — | 300 | C2 | 20 | 10 |
| 6 | P2 | PY74 PY155 (*1) | 6.2 | Done | MA | — | — | 90 | C1 | 20 | 10 |
| 7 | P4 | PY74 | 5.5 | Done | MA | EA | 80 | 340 | C1 | 20 | 10 |
| 8 | P5 | PY155 | 6.2 | Not Done | — | MA | 200 | 200 | C1 | 20 | 10 |
| 9 | P2 | PY74 PY155 (*1) | 3.0 | Done | MA | — | — | 40 | C1 | 20 | 10 |
| 10 | P6 | PY155 | 5.5 | Not Done | — | — | — | 0 | C1 | 20 | 10 |
| 11 | P7 | PY155 | 12.0 | Not Done | — | MA | 400 | 400 | C1 | 20 | 10 |
| 12 | P3 | PY74 | 6.2 | Not Done | MA | — | — | 800 | C1 | 20 | 10 |

| | Amorphous resin | | | Releasing agent | | | |
|---|---|---|---|---|---|---|---|
| Toner number | High molecular component | Acid value (mg KOH/g) | Low molecular component | Kind | Melting point (° C.) | ※2 | Remarks |
| 1 | A1 | 15 | B1 | W1 | 70 | 14 | Inv. |
| 2 | A1 | 15 | B1 | W2 | 85 | 15 | Inv. |
| 3 | A1 | 15 | B1 | W3 | 80 | 14 | Inv. |
| 4 | A1 | 15 | B1 | W4 | 73 | 15 | Inv. |
| 5 | A1 | 15 | B1 | W1 | 70 | 14 | Inv. |
| 6 | A1 | 15 | B1 | W1 | 70 | 5 | Inv. |
| 7 | A1 | 15 | B1 | W1 | 70 | 15 | Inv. |
| 8 | A1 | 15 | B1 | W1 | 70 | 11 | Inv. |
| 9 | A1 | 15 | B1 | W1 | 70 | 2 | Inv. |
| 10 | A1 | 15 | B1 | W1 | 70 | 0 | Comp. |
| 11 | A1 | 15 | B1 | W1 | 70 | 20 | Comp. |
| 12 | A1 | 15 | B1 | W1 | 70 | 17 | Comp. |

(*1) PY74 and PY155 were used with a ratio of 1:1

(*2) Content (mass ppm) of alkoxy aniline in toner particles

Inv. = Inventive example

Comp. = Comparative example

<Evaluation Methods>

Low-temperature fixing property and toner scattering of the toners were respectively evaluated.

(Evaluation of Low-Temperature Fixing Property)

As an image-forming apparatus, it was used a multi-function printer "Bizhub™ C754" (made by Konica Minolta, Inc.) with modifying the fixing device in such a manner that the surface temperature of the fixing upper belt and the fixing under roller was adjustable. The developers produced by using the toners were respectively charged to the apparatus. As a paper for evaluation, "mondi Color Copy A4 90 g/m$^2$" (made by Mondi Co. Ltd.) was used. A fixing test was repeatedly conducted to fix a solid image having an amount of adhered toner of 11.3 g/m$^2$ under the conditions of: nip width of 11.2 mm, fixing time of 34 msec, fixing pressure of 133 kPa, and fixing temperature from 100° C. to 200° C. by changing the fixing temperature with a step of 5° C. The fixing tests were repeated until the moment of appearing cold offset. The lowest surface temperature of the fixing upper belt without producing cold offset was checked. This temperature was recorded as a lowest fixing temperature and the low-temperature fixing property was evaluated. The evaluation results are listed in Table 2. Here, in the evaluation test, "a fixing temperature" indicates a surface temperature of the fixing upper belt. When the lowest fixing temperature is smaller, it indicates that it is excellent in the low-temperature fixing property.

In the present evaluation, when the lowest fixing temperature was 160° C. or less, it was decided that the developer passed the examination.

(Evaluation of Scattering Property)

As an evaluation apparatus, it was used a modified multi-function printer "Bizhub™ C754" (made by Konica Minolta, Inc.). After making 100,000 sheets of prints, the developing device was taken out, and it was set to a rotary device. An A4 white paper was set under the developing sleeve by locating the position of the developing sleeve in the center of the paper. The developing sleeve was rotated for 60 minutes, and the mass of the fallen toner (toner scattering amount) was measured to evaluate. The rotation circumferential speed of the developing sleeve was made to be 620 mm/sec. When the toner scatting amount was 9 mg or less, it was decided that the developer passed the examination. The evaluation results are listed in Table 2.

TABLE 2

| Toner number | Low-temperature fixing property Lowest fixing temperature (° C.) | Scattering property Toner scattering amount (mg) | Remarks |
|---|---|---|---|
| 1 | 145 | 3 | Inv. |
| 2 | 150 | 4 | Inv. |
| 3 | 150 | 4 | Inv. |
| 4 | 145 | 5 | Inv. |
| 5 | 155 | 7 | Inv. |
| 6 | 155 | 7 | Inv. |
| 7 | 145 | 9 | Inv, |
| 8 | 140 | 8 | Inv. |
| 9 | 140 | 5 | Inv. |
| 10 | 165 | 2 | Comp. |
| 11 | 145 | 11 | Comp. |
| 12 | 145 | 13 | Comp. |

Inv. = Inventive example
Comp. = Comparative example

As indicated in Table 2, it was found that the toners according to the present invention exhibited an excellent low-temperature fixing property and a small amount of toner scattering. On the other hand, the comparative toners were found to exhibit an inferior result in at least one of low-temperature fixing property and toner scattering property.

What is claimed is:

1. An electrostatic image developing toner containing toner particles having a domain-matrix structure formed with a matrix of an amorphous polyester resin and a domain of a crystalline resin, wherein the toner particles contain an releasing agent and alkoxy aniline; and a content of the alkoxy aniline contained in the toner particles is in the range of 0.1 to 15.0 mass ppm.

2. The electrostatic image developing toner described in claim 1, wherein the releasing agent has a melting point in the range of 60 to 90° C.

3. The electrostatic image developing toner described in claim 1, wherein the toner particles contain C. I. Pigment Yellow 74 as a pigment.

4. The electrostatic image developing toner described in claim 3, wherein the toner particles contain at least one pigment selected from the group consisting of: C. I. Pigment Yellow 93, C. I. Pigment Yellow 155, C. I. Pigment Yellow 180, C. I. Pigment Yellow 185, C. I. Solvent Yellow 93, and C. I. Solvent Yellow 163.

5. The electrostatic image developing toner described in claim 1, wherein the crystalline resin in the toner particles is a crystalline polyester resin.

6. The electrostatic image developing toner described in claim 5, wherein a content of the crystalline polyester resin in the toner particles is in the range of 5 to 30 mass %.

7. The electrostatic image developing toner described in claim 5, wherein the crystalline polyester resin is a hybrid resin bonded with an amorphous resin segment.

8. The electrostatic image developing toner described in claim 5, wherein the crystalline polyester resin has an acid value in the range of 15 to 30 mg KOH/g.

9. The electrostatic image developing toner described in claim 1, wherein the alkoxy aniline is 2-methoxyaniline.

10. The electrostatic image developing toner described in claim 5, wherein the amorphous polyester resin has a high molecular weight component and a low molecular weight component;

the high molecular weight component has a weight average molecular weight (Mw) in the range of 30,000 to 300,000; and the low molecular weight component has a weight average molecular weight (Mw) in the range of 8,000 to 25,000.

11. The electrostatic image developing toner described in claim 10, wherein the high molecular weight component in the amorphous polyester resin has an acid value smaller than the acid value of the crystalline polyester resin.

* * * * *